US010619487B2

(12) United States Patent
Rathay et al.

(10) Patent No.: US 10,619,487 B2
(45) Date of Patent: Apr. 14, 2020

(54) COOLING ASSEMBLY FOR A TURBINE ASSEMBLY

(71) Applicant: General Electric Company, Schenectady, NY (US)

(72) Inventors: Nicholas William Rathay, Rock City Falls, NY (US); Satoshi Atsuchi, Rexford, NY (US); David Weber, Greenville, SC (US); Gustavo Ledezma, Delmar, NY (US); Gary Itzel, Greenville, SC (US)

(73) Assignee: GENERAL ELECTRIC COMAPNY, Schenectady, NY (US)

( * ) Notice: Subject to any disclaimer, the term of this patent is extended or adjusted under 35 U.S.C. 154(b) by 186 days.

(21) Appl. No.: 15/420,329

(22) Filed: Jan. 31, 2017

(65) Prior Publication Data

US 2018/0216471 A1 Aug. 2, 2018

(51) Int. Cl.

| | |
|---|---|
| ***F01D 5/18*** | (2006.01) |
| ***F01D 5/14*** | (2006.01) |
| ***F01D 5/20*** | (2006.01) |

(52) U.S. Cl.

CPC ..... *F01D 5/18* (2013.01); *F01D 5/147* (2013.01); *F01D 5/20* (2013.01); *F05D 2220/32* (2013.01); *F05D 2240/307* (2013.01); *F05D 2260/202* (2013.01); *F05D 2260/232* (2013.01)

(58) Field of Classification Search

CPC ..... F05D 2260/202; F01D 5/20; F01D 5/18; F01D 5/186; F01D 5/187; F01D 5/00; Y02T 50/676

USPC ..... 415/115; 416/97 R

See application file for complete search history.

(56) References Cited

U.S. PATENT DOCUMENTS

| | | | | |
|---|---|---|---|---|
| 2,868,439 | A * | 1/1959 | Hampshire | F01D 5/282 415/141 |
| 4,390,320 | A | 6/1983 | Eiswerth et al. | |
| 5,688,107 | A | 11/1997 | Downs et al. | |
| 6,478,537 | B2 | 11/2002 | Junkin | |
| 7,029,235 | B2 | 4/2006 | Liang | |
| 7,922,451 | B1 | 4/2011 | Liang | |
| 8,182,221 | B1 | 5/2012 | Liang | |
| 8,206,108 | B2 | 6/2012 | Riahi et al. | |
| 8,454,310 | B1 | 6/2013 | Downs et al. | |
| 8,469,666 | B1 | 6/2013 | Liang | |

(Continued)

FOREIGN PATENT DOCUMENTS

| | | |
|---|---|---|
| EP | 1762701 | 3/2007 |

*Primary Examiner* — David E Sosnowski
*Assistant Examiner* — Maranatha Boardman
(74) *Attorney, Agent, or Firm* — The Small Patent Law Group LLC; Christopher Carroll

(57) ABSTRACT

A cooling assembly includes a cooling chamber disposed inside of a turbine assembly. The cooling chamber directs cooling air inside an airfoil of the turbine assembly. The cooling assembly includes a metered channel fluidly coupled with the cooling chamber. The metered channel directs at least some of the cooling air out of the cooling chamber outside of a rail surface of the airfoil. The metered channel is elongated along and encompasses an axis. The metered channel has an interior surface with a distance between opposing first portions of the interior surface. The distance between the opposing first portions decreases at increasing distances along the axis from the cooling chamber toward the rail surface.

26 Claims, 9 Drawing Sheets

(56) References Cited

U.S. PATENT DOCUMENTS

| | | | | |
|---|---|---|---|---|
| 8,506,241 | B1 * | 8/2013 | Liang | F01D 5/14 415/115 |
| 8,628,299 | B2 | 1/2014 | Ammann et al. | |
| 9,188,012 | B2 | 11/2015 | Lacy et al. | |
| 9,249,670 | B2 | 2/2016 | Bunker | |
| 9,273,561 | B2 | 3/2016 | Lacy et al. | |
| 2010/0226790 | A1 * | 9/2010 | Liang | F01D 5/187 416/97 R |

* cited by examiner

COOLING ASSEMBLY FOR A TURBINE ASSEMBLY

FIELD

The subject matter described herein relates to cooling turbine assemblies.

BACKGROUND

The turbine assembly can be subjected to increased heat loads when an engine is operating. To protect the turbine assembly components from damage, cooling fluid may be directed in and/or onto the turbine assembly. Component temperature can then be managed through a combination of impingement onto, cooling flow through passages in the component, and film cooling with the goal of balancing component life and turbine efficiency. Improved efficiency can be achieved through increasing the firing temperature, reducing the cooling flow, or a combination.

One issue with cooling known turbine assemblies is inadequate cooling on squealer tips of turbine blades. The rail of the squealer tip is subjected to high heat loads, making the rail one of the hottest regions of the turbine blade. Furthermore, the rail of the squealer tip frequently rubs against other components within the turbine assembly during operation, potentially causing cooling holes or slots placed through the rail to plug. Plugged cooling holes may prevent coolant from flowing through the rail, thus causing the surface temperatures of the rail to remain excessively high, which increases the total heat load of the turbine assembly and may reduce part life below acceptable levels or require use of additional cooling fluid. Therefore, an improved system may provide improved cooling coverage and thereby reduce the average and/or local surface temperature of critical portions of the turbine assembly, enable more efficient operation of the engine, and/or improve the life of the turbine machinery.

BRIEF DESCRIPTION

In one embodiment, a cooling assembly includes a cooling chamber disposed inside of a turbine assembly. The cooling chamber is configured to direct cooling air inside an airfoil of the turbine assembly. The cooling assembly includes a metered channel fluidly coupled with the cooling chamber. The metered channel is configured to direct at least some of the cooling air out of the cooling chamber outside of a rail surface of the airfoil. The metered channel is elongated along and encompasses an axis. The metered channel has an interior surface with a distance between opposing first portions of the interior surface. The distance between the opposing first portions of the interior surface decreases at increasing distances along the axis from the cooling chamber toward the rail surface.

In one embodiment, a cooling assembly includes a cooling chamber disposed inside of a turbine assembly. The cooling chamber is configured to direct cooling air inside an airfoil of the turbine assembly. The cooling assembly includes a metered channel fluidly coupled with the cooling chamber. The metered channel is configured to direct at least some of the cooling air out of the cooling chamber outside of a rail surface of the airfoil. The metered channel has an inlet at an interior intersection between the metered channel and the cooling chamber and the metered channel has an outlet at an exterior intersection between the metered channel and the rail surface, wherein the inlet has a first area and the outlet has a second area that is smaller than the first area.

In one embodiment, a cooling assembly includes a cooling chamber disposed inside a turbine assembly. The cooling chamber is configured to direct cooling air inside an airfoil of the turbine assembly. The cooling assembly includes a metered channel fluidly coupled with the cooling chamber. The metered channel is configured to direct at least some of the cooling air out of the cooling chamber outside of a rail surface of the airfoil. One or more contingency holes are fluidly coupled with the metered channel. The contingency holes are configured to direct at least some of the cooling air out of the metered channel outside of an exterior surface of the airfoil.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein relates to systems and methods that effectively cool a rail of a turbine airfoil squealer tip. Turbine airfoil squealer tips are used to help to reduce aerodynamic losses and therefore increase the efficiency of the turbine assembly. The rail surface of the squealer tip is subjected to high heat loads and is difficult to effectively cool. The systems and methods fluidly couple an internal cooling chamber with the rail surface by a metered channel, and fluidly couple the metered channel with an exterior surface near the rail surface by a relief hole. For example, cooling air may be directed onto more than one exterior surfaces of the airfoil at or near the rail surface in order to effectively cool the squealer tip of the airfoil. Often, channels passing coolant directly onto the upper rail surface of the squealer tip become blocked due to a frequent rubbing operation of the airfoil at the rail surface. One technical effect of the subject matter herein is increasing the effectiveness of cooling the squealer tip of the airfoil. One technical effect of the subject matter herein is a contingency relief hole that is disposed near the rail surface in order to pass coolant across the rail if the channel on the rail surface becomes blocked. One technical effect of the subject matter herein is that improved cooling may extend part life and reduce unplanned outages.

Figure 1:
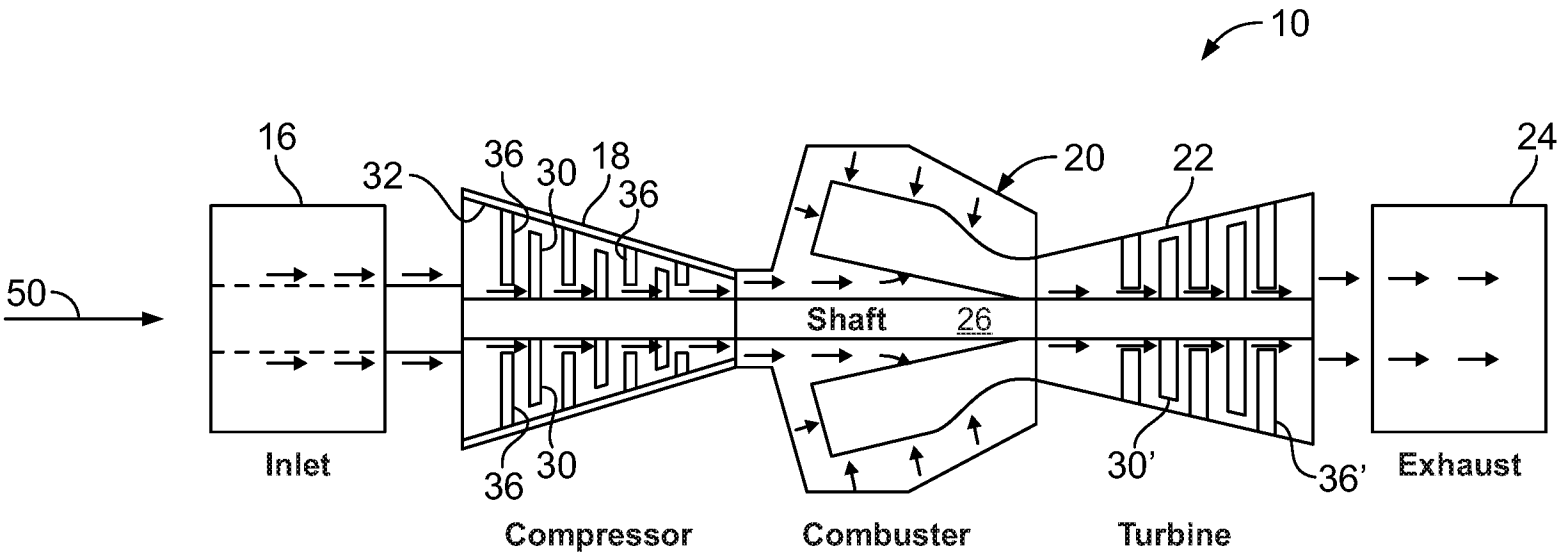
FIG. 1 illustrates a turbine assembly in accordance with one embodiment.

FIG. 1 illustrates a turbine assembly 10 in accordance with one embodiment. The turbine assembly 10 includes an inlet 16 through which air enters the turbine assembly 10 in the direction of arrow 50. The air travels in a direction 50 from the inlet 16, through a compressor 18, through a combustor 20, and through a turbine 22 to an exhaust 24. A rotating shaft 26 runs through and is coupled with one or more rotating components of the turbine assembly 10.

The compressor 18 and the turbine 22 comprise multiple airfoils enclosed by an outer casing 32. The airfoils may be one or more of blades 30, 30' or guide vanes 36, 36'. The blades 30, 30' are axially offset from the guide vanes 36, 36' in the direction 50. The guide vanes 36, 36' are stationary components. The blades 30, 30' are operably coupled with and rotate with the shaft 26.

Figure 2:
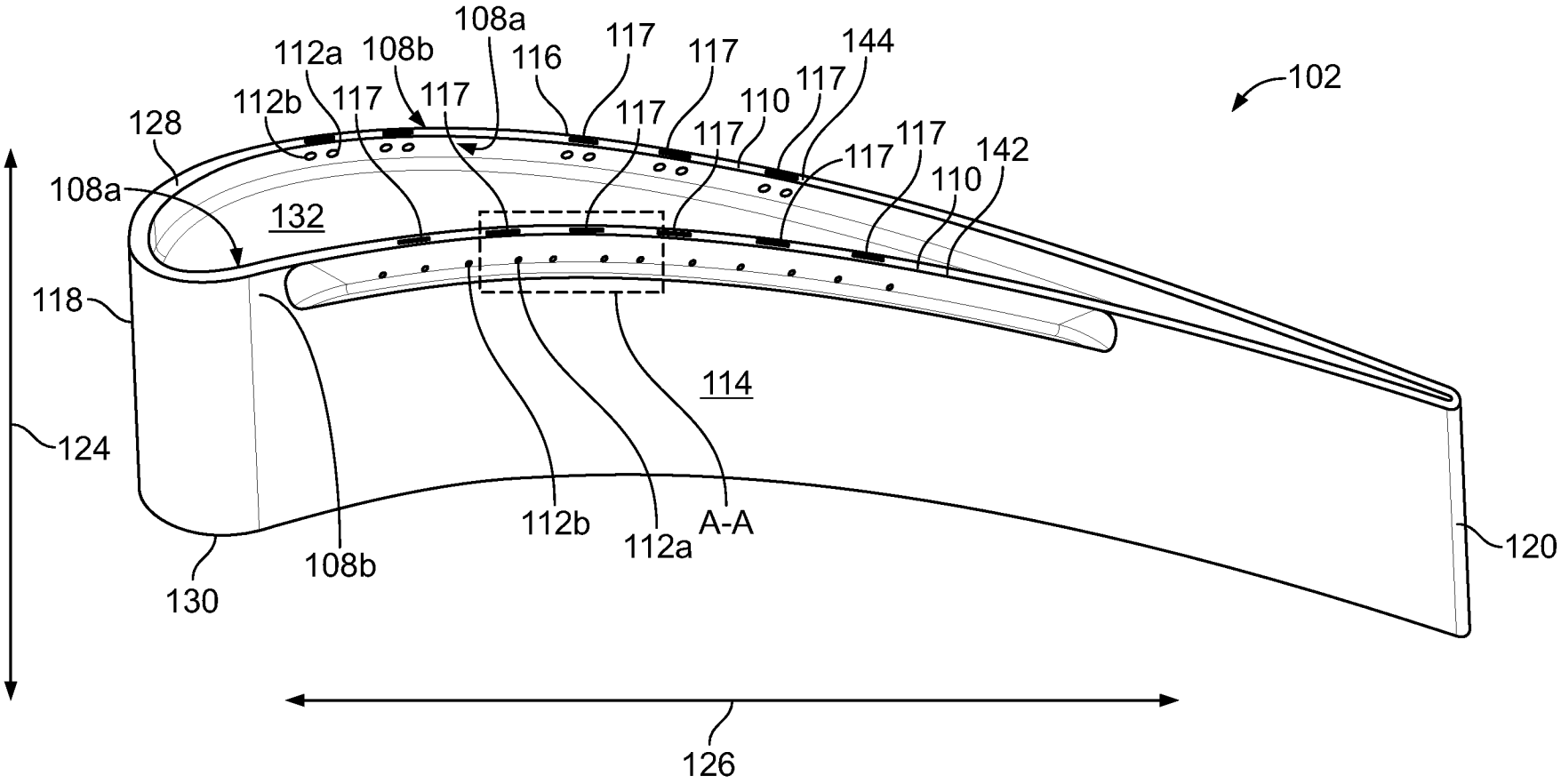
FIG. 2 illustrates a perspective view of an airfoil in accordance with one embodiment.

FIG. 2 illustrates a perspective view of an airfoil 102 of the turbine assembly 10 of FIG. 1 in accordance with one embodiment. The airfoil 102 may be a turbine blade used in the turbine assembly 10. The airfoil 102 has a pressure side 114 and a suction side 116 that is opposite the pressure side 114. The pressure side 114 and the suction side 116 are interconnected by a leading edge 118 and a trailing edge 120 that is opposite the leading edge 118. The pressure side 114 is generally concave in shape, and the suction side 116 is generally convex in shape between the leading and trailing edges 118, 120. For example, the generally concave pressure side 114 and the generally convex suction side 116 provides an aerodynamic surface over which compressed working fluid flows through the turbine assembly.

The airfoil 102 extends an axial length 126 between the leading edge 118 and the trailing edge 120. Optionally, the axial length 126 may be referred to as a chordwise length between the leading and trailing edges 118, 120. The trailing edge 120 is disposed proximate the shaft 26 of the turbine assembly 10 relative to the leading edge 118 along the axial length 126. The airfoil 102 extends a radial length 124 between a first end 128 and a second end 130. For example, the axial length 126 is generally perpendicular to the radial length 124.

The first end 128 of the airfoil 102 has a rail surface 110. The rail surface 110 is a blade tip rail commonly referred to as a squealer tip. The rail surface 110 includes a pressure side rail 142 and a suction side rail 144, respectively positioned on the pressure and suction sides 114, 116 of the airfoil 102. The rail surface 110 extends along the perimeter of the pressure side 114 and the suction side 116 between the leading edge 118 and the trailing edge 120. Optionally, the rail surface 110 may extend along the perimeter of only one of the pressure side 114 or suction side 116. Optionally, the rail surface may extend along the pressure and suction sides 114, 116, with one or more rail surfaces extending between the pressure and suction sides 114, 116 and between the leading edge 118 and the trailing edge 120.

The airfoil 102 has a tip floor surface 132 near the first end 128 that extends between the pressure side 114 and the suction side 116 of the airfoil 102. The pressure side rail 142 extends radially outwardly from the tip floor surface 132 and extends between the leading edge 118 and the trailing edge 120 along the axial length 126 of the airfoil 102. For example, the pressure side rail 142 extends a distance away from the tip floor surface 132 along the radial length 124 of the airfoil 102. The path of the pressure side rail 142 is adjacent to or near the outer radial edge of the pressure side 114 such that the pressure side rail 142 aligns with the outer radial edge of the pressure side 114. The suction side rail 144 extends radially outward from the tip floor surface 132 and extends between the leading edge 118 and the trailing edge 120 along the axial length 126 of the airfoil 102. For example, the suction side rail 144 extends a distance away from the tip floor surface 132 along the radial length 124 of the airfoil 102. The path of the suction side rail 144 is adjacent to or near the outer radial edge of the suction side 116 of the airfoil 102 such that the suction side rail 144 aligns with the outer radial edge of the suction side 116. Optionally, the pressure side rail 142 and the suction side rail 144 may follow an alternative profile between the leading edge 118 and the trailing edge 120 along the axial length 126 of the airfoil 102. For example, the pressure side rail 142 and/or the suction side rail 144 may be moved a distance away from the outer radial edge of the pressure or suction sides 114, 116, respectively.

The airfoil 102 has one or more channel outlets 117 and one or more contingency holes 112*a*, 112*b*. The channel outlets 117 are disposed on the rail surface 110 of the pressure side rail 142 and the suction side rail 144. For example, in the illustrated embodiment, the channel outlets 117 are disposed on the pressure side and suction side rails 142, 144 between the leading edge 118 and the trailing edge 120 of the airfoil 102. Optionally, the channel outlets 117 may be disposed on one of the pressure side or suction side rails 142, 144. The contingency holes 112*a*, 112*b* are disposed on exterior surfaces 108*a*, 108*b* of the rail surface 110. For example, the contingency holes 112*a*, 112*b* disposed on the pressure side rail 142 are disposed on an outer rail exterior surface 108*b*, and the contingency holes 112*a*, 112*b* disposed on the suction side rail 144 are disposed on an inner rail exterior surface 108*a*. The contingency holes 112 are positioned at a distance between the tip floor surface 132 and the rail surface 110 along the radial length 124 of the airfoil 102.

The channel outlets 117 and contingency holes 112 are fluidly coupled with a cooling chamber disposed within the interior of the airfoil 102 via one or more metered channels. The metered channels, channel outlets, contingency holes, and cooling chamber will be discussed in more detail below.

Figure 3:
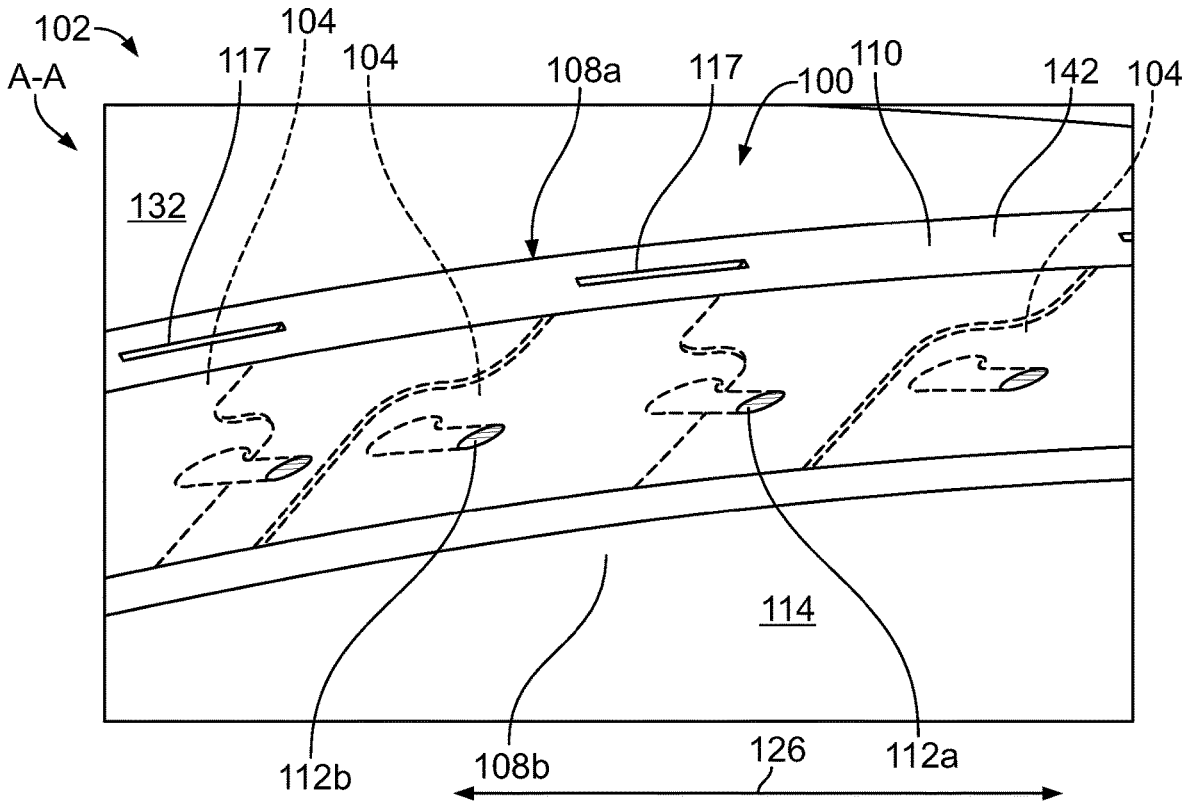
FIG. 3 illustrates a translucent view of the cooling assembly of FIG. 2 in accordance with one embodiment.

FIG. 3 illustrates a detailed, translucent view of the section A-A of a cooling assembly 100 at the first end 128 of the airfoil 102 of FIG. 2. The cooling assembly 100 may operator to help cool the airfoil 102 of the turbine assembly 10. The cooling assembly 100 has one or more metered channels 104 fluidly coupled with the channel outlets 117 and the contingency holes 112*a*, 112*b*. In the illustrated embodiment, three metered channels 104 are disposed within the pressure side rail 142 with the channel outlets 117 disposed on the rail surface 110 and the contingency holes 112*a*, 112*b* disposed on the outer rail exterior surface 108*b* of the pressure side 114 of the airfoil 102.

Figure 4:
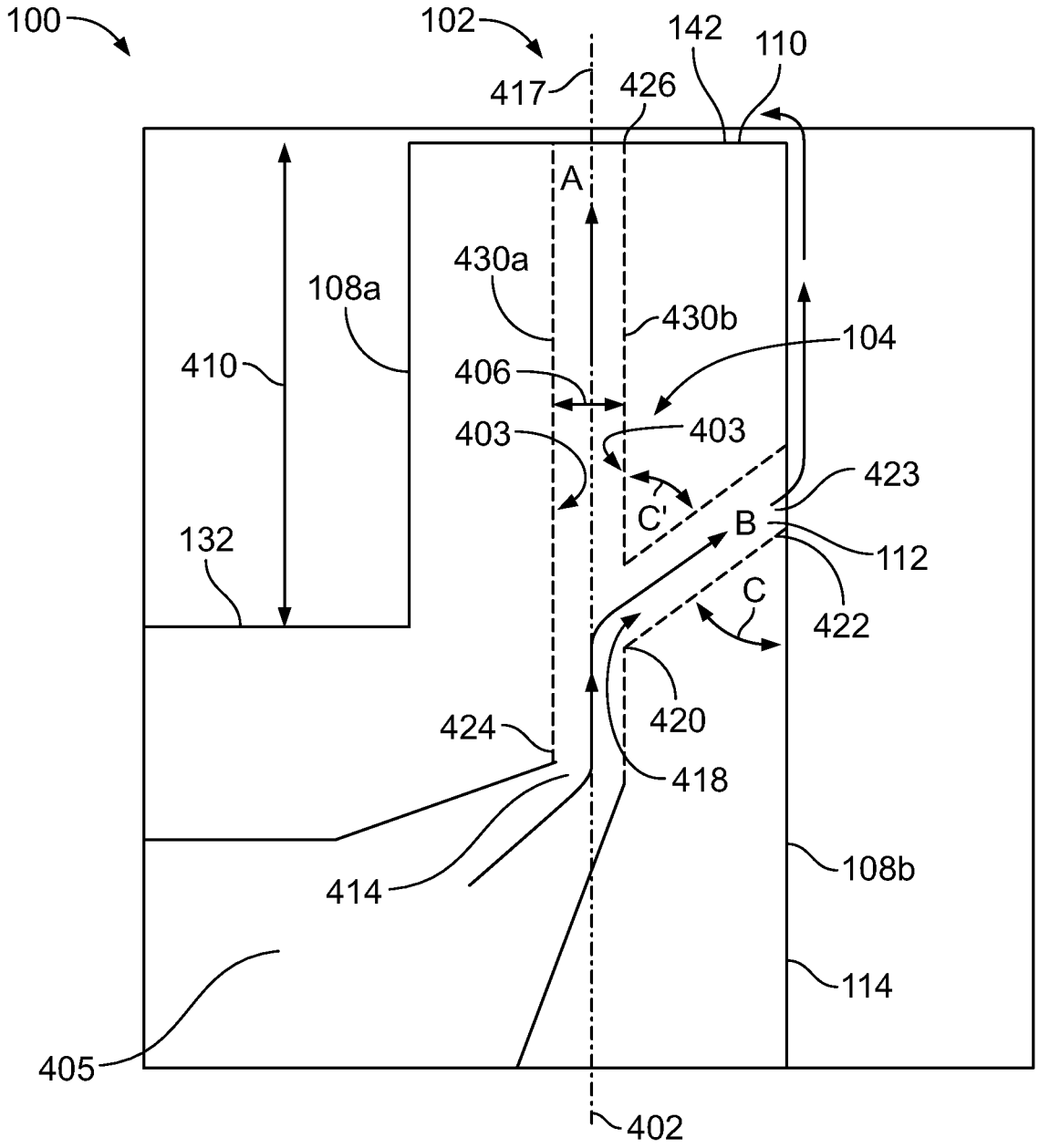
FIG. 4 illustrates a cross-sectional front view of a cooling assembly of a pressure side rail in accordance with one embodiment.

FIG. 4 illustrates a cross-sectional front view of the cooling assembly 100 disposed on the pressure side rail 142 in accordance with one embodiment. The pressure side rail 142 extends a distance 410 away from the tip floor surface 132 of the airfoil 102. For example, the pressure side rail 142 extends the distance 410 such that the rail surface 110 is disposed distal the second end 130 (of FIG. 2) than the tip floor surface 132 along the radial length 124 of the airfoil 102. The rail surface 110 and the tip floor surface 132 are generally parallel. Optionally, the rail surface 110 and the tip floor surface 132 may be non-parallel. The pressure side rail 142 has an inner rail exterior surface 108*a* and an outer rail exterior surface 108*b*. For example, the inner rail exterior surface 108*a* is disposed facing in a direction towards the suction side rail 144 (of FIG. 2) and the outer rail exterior surface 108*b* is disposed facing in a direction away from the suction side rail 144.

The airfoil 102 has an internal cooling chamber 405 that is disposed within the interior of the airfoil 102. For example, the cooling chamber 405 is entirely contained within the airfoil 102. The metered channel 104 is elongated along an axis 402 between an interior intersection 424 between the cooling chamber 405 and the metered channel 104, and an exterior intersection 426 between the metered channel 104 and the rail surface 110. The metered channel 104 has a first channel inlet 414 at the interior intersection 424 and an outlet 417 (corresponding to the channel outlet 117 of FIG. 2) at the exterior intersection 426. Additionally, the contingency hole 112 extends between an interior hole intersection 420 between the metered channel 104 and the contingency hole 112, and an exterior hole intersection 422 between the contingency hole 112 and the outer rail exterior surface 108*b* of the airfoil 102. The contingency hole 112 has a hole inlet 418 at the interior hole intersection 420 and a hole outlet 423 at the exterior hole intersection 422.

The contingency hole 112 is angularly offset from the outer rail exterior surface 108*b* by an angular degree C. For example, the contingency hole 112 may be angularly offset by 90 degrees or less. Optionally, the contingency hole may be angularly offset by more than 90 degrees. Optionally, the contingency hole 112 may be angularly offset from the axis 402 of the metered channel 104 by the angular degree C. For example, the contingency hole 112 may be a passage that extends linearly between the hole inlet 418 and hole outlet 423. Optionally, the contingency hole 112 may extend non-linearly between the hole inlet 418 and outlet 423. For example, the contingency hole 112 may be angularly offset from the outer rail exterior surface 108*b* by the angular degree C., and may be angularly offset from the metered channel by a second, different angular degree C.

The cooling chamber 405 is fluidly coupled with the metered channel 104 and the contingency hole 112. In the illustrated embodiment, the metered channel 104 fluidly couples the cooling chamber 405 with the rail surface 110. Additionally, the contingency hole 112 fluidly couples the metered channel 104 with the outer rail exterior surface 108*b*. For example, the metered channel 104 directs at least some of the cooling air exiting the cooling chamber 405 in a direction A towards the rail surface 110 and some of the cooling air exiting the cooling chamber 405 in a direction B towards the outer rail exterior surface 108*b* via the contingency hole 112.

Figure 5:
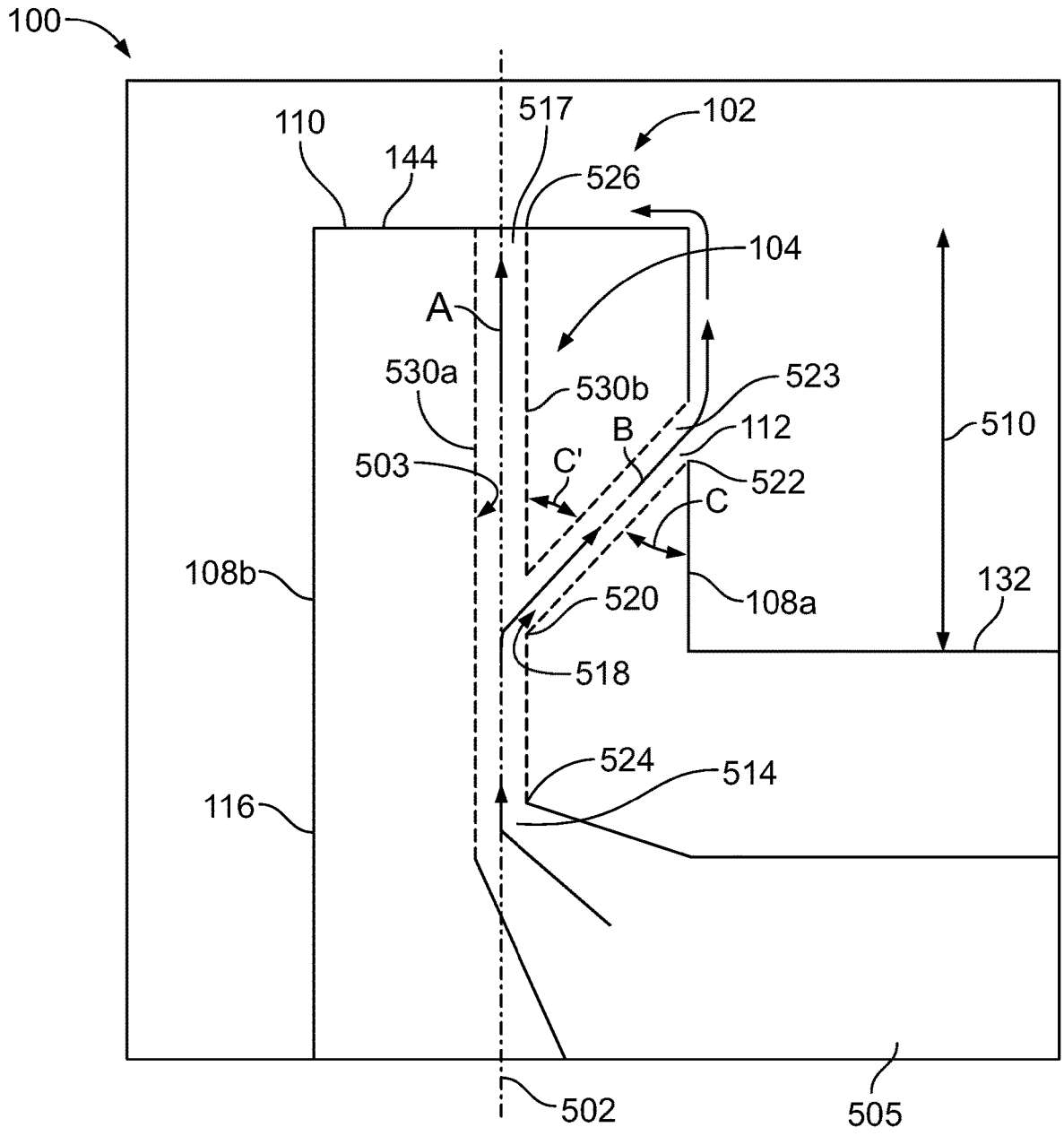
FIG. 5 illustrates a cross-sectional front view of a cooling amenably of a suction side rail in accordance with one embodiment.

FIG. 5 illustrates a cross-sectional front view of the cooling assembly 100 of the suction side rail 144 in accordance with one embodiment. The suction side rail 144 extends a distance 510 away from the tip floor surface 132 of the airfoil 102. For example, the suction side rail 144 extends the distance 510 such that the rail surface 110 is disposed distal the second end 130 than the tip floor surface 132 along the radial length 124 of the airfoil 102. In the illustrated embodiment of FIGS. 2, 4 and 5, the distance 510 is generally the same as the distance 410. Optionally, the distance 510 may be the same or different than the distance 410 (of FIG. 4). The suction side rail 144 has an inner rail exterior surface 108*a* and an outer rail exterior surface 108*b*. For the example, the inner rail exterior surface 108*a* is disposed facing in a direction towards the pressure side rail 142 (of FIG. 2) and the outer rail exterior surface 108*b* is disposed facing in a direction away from the pressure side rail 142.

The airfoil 102 has an internal cooling chamber 505 that is disposed within the interior of the airfoil 102. For example, the cooling chamber 505 is entirely contained within the airfoil 102. Optionally, the cooling chamber 405 (of FIG. 4) and cooling chamber 505 (of FIG. 5) may be a single internal cooling chamber that extends between the pressure and suction sides 114, 116 of the airfoil 102. Additionally or alternatively, the cooling chamber 405 may be a distinct cooling chamber and separated from the cooling chamber 505. Optionally, the airfoil 102 may include any number of internal cooling chambers that are configured to direct cooling air inside of the airfoil 102 of the turbine assembly 10.

The metered channel 104 is elongated along an axis 502 between an interior intersection 524 between the cooling chamber 505 and the metered channel 104, and an exterior intersection 526 between the metered channel 104 and the rail surface 110. The metered channel 104 has a channel inlet 514 at the interior intersection 524 and a channel outlet 517 (corresponding to the channel outlet 117 of FIG. 2) at the exterior intersection 526. Additionally, the contingency hole 112 extends between an interior hole intersection 520 between the metered channel 104 and the contingency hole 112 and an exterior hole intersection 522 between the contingency hole 112, and the inner rail exterior surface 108*a* of the airfoil 102. The contingency hole 112 has a hole inlet 518 at the interior hole intersection 520 and a hole outlet 523 at the exterior hole intersection 522.

The contingency hole 112 is angularly offset from the inner rail exterior surface 108*a* by an angular degree C. For example, the contingency hole 112 may be angularly offset by 90 degrees or less. Optionally, the contingency hole may be angularly offset by more than 90 degrees. Optionally, the contingency hole 112 may be angularly offset from the axis 502 of the metered channel 104 by the angular degree C.'. For example, the contingency hole 112 may be a passage that extends linearly between the hole inlet 518 and hole outlet 523. Optionally, the contingency hole 112 may extend non-linearly between the hole inlet 518 and outlet 523. For example, the contingency hole 112 may be angularly offset from the inner rail exterior surface 108*a* by the angular degree C. and may be angularly offset from the metered channel 104 by a second, different angular degree C.'.

The cooling chamber 505 is fluidly coupled with the metered channel 104 and the contingency hole 112. In the illustrated embodiment, the metered channel 104 fluidly couples the cooling chamber 505 with the rail surface 110. Additionally, the contingency hole 112 fluidly couples the metered channel 104 with the inner rail exterior surface 108*a*. For example, the metered channel 104 directs at least some of the cooling air exiting the cooling chamber 505 in a direction A towards the rail surface 110 and some of the cooling air exiting the cooling chamber 505 in a direction B towards the inner rail exterior surface 108*a* via the contingency hole 112.

Figure 6:
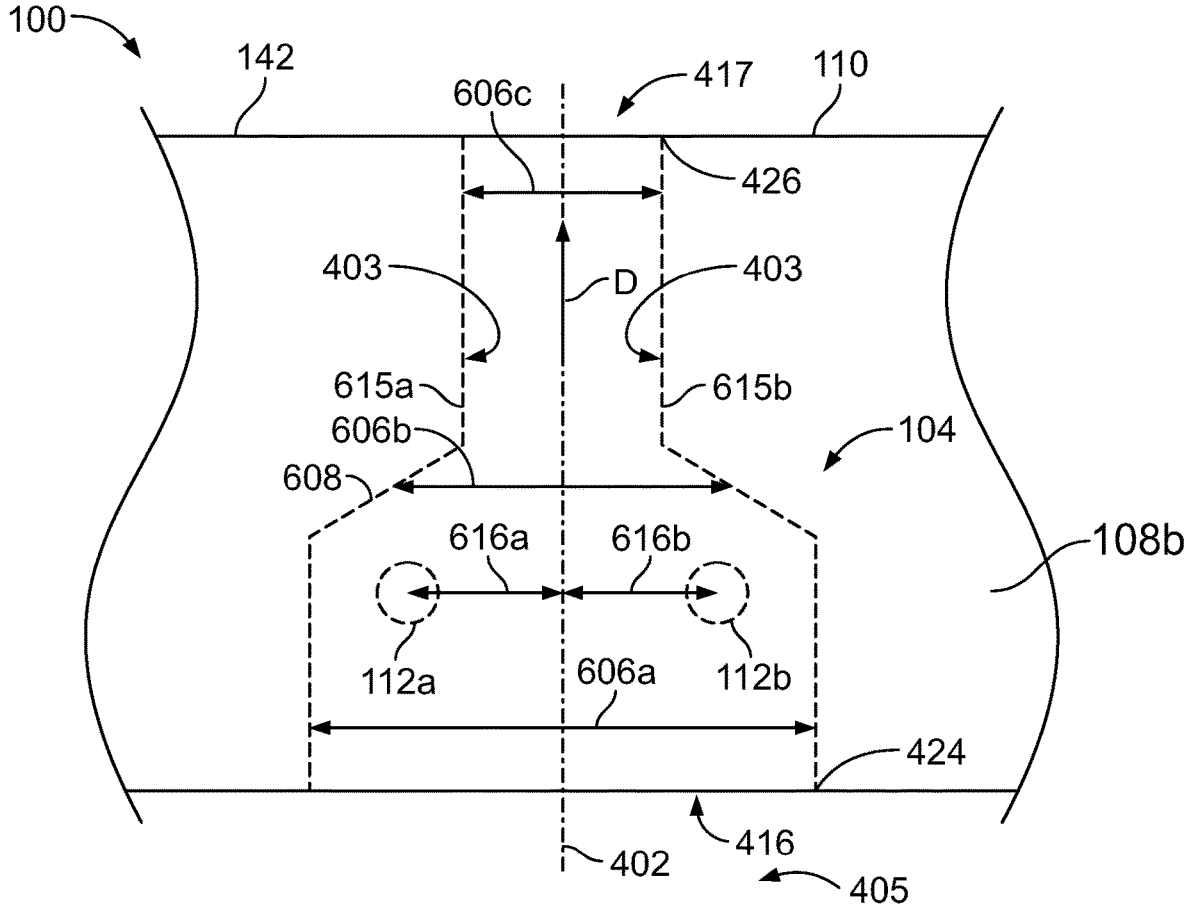
FIG. 6 illustrates a cross-sectional side view of the cooling assembly of FIG. 4 in accordance with one embodiment.

FIG. 6 illustrates a cross-sectional side view of the cooling assembly 100 in accordance with one embodiment.

In the illustrated embodiment, the cooling assembly 100 is disposed with the pressure side rail 142. Additionally or alternatively, FIG. 6 may illustrate the cooling assembly 100 disposed within the pressure side rail 142 and/or the suction side rail 144. The cooling assembly 100 includes the metered channel 104 that fluidly couples the cooling chamber 405 with the rail surface 110, and contingency holes 112 that fluidly couple the metered channel 104 with the exterior surface 108. For example, the metered channel 104 is a passage between a second channel inlet 416 at the interior intersection 424 between the cooling chamber 405 and the metered channel 104, and the channel outlet 417 at the exterior intersection 426 between the metered channel 104 and the rail surface 110. Additionally, the contingency holes 112 are a passage between the hole inlets 418 at the interior hole intersection 420 between the metered channel. 104 and the contingency holes 112, and the hole outlets 423 at the exterior hole intersections 422 between the contingency holes 112 and the outer rail exterior surface 108*b* (of FIG. 4).

The metered channel 104 is elongated along and encompasses the axis 402. For example, the axis 402 extends through the general center of the metered channel 104, with the metered channel 104 being symmetric or substantially symmetric (symmetric within manufacturing tolerances) about or on either side of the axis 402. In the illustrated embodiment, the axis 402 is generally perpendicular to the interior and exterior intersections 424, 426. Optionally, the axis 402 may extend between the cooling chamber 405 and the rail surface 110 such that the axis 402 is radially offset between the interior and exterior intersections 424, 426. The metered channel 104 includes an interior surface 403 having opposing first portions 615*a*, 615*b* and opposing second portions 430*a*, 430*b* (of FIG. 4). The metered channel 104 encompasses the axis 402 such that the axis 402 is generally centered between the opposing first portions 615*a*, 615*b*, and is generally centered between the opposing second portions 430*a*, 430*b*. For example, the opposing first portions 615*a*, 615*b* are generally mirrored about the axis 402 between the cooling chamber 405 and the rail surface 110. Optionally, the opposing first portions 615*a*, 615*b* may not be mirrored or generally mirrored about the axis 402

The metered channel 104 includes distances 606*a*, 606*b*, 606*c* between the opposing first portions 615*a*, 615*b* of the interior surface 403. The distances 606*a*, 606*b*, 6060 generally decreases at increasing distances along the axis 402 in the direction D from the cooling chamber 405 to the rail surface 110. For example, the distances 606*a*, 606*h*, 606*c* may be the distance measured along the shortest path between opposing first portions 615*a*, 615*b*. In the illustrated embodiment, the metered channel 104 includes stepped decreasing distances 606*a*, 606*b*, 606*c* at increasing distances along the axis 402. For example, the distance 606*a* remains generally uniform along the axis 402 from the interior intersection 424 to a step 608. At the step 608, the distance 606*b* continually decreases along the axis 402. After the step 608 (e.g., at increasing distances along the axis 402), the distance 606*c* remains generally uniform along the axis 402 from the step 608 to the exterior intersection 426. Optionally, the distances 606*a*, 606*b*, 606*c* may continually decrease at increasing distances along the axis 402. For example, the distance 606*a* may be largest at or near the interior intersection 424. The distance 606*b* may be smaller at or near the middle of the metered channel 104 along the axis 402 (e.g., at the step 608), and may be smallest (e.g., as the distance 6060 at or near the exterior intersection 426. For example, the distance 606*a*, disposed near the interior intersection 424, has a distance that is greater than the distance 606*b*, and has a distance greater than the distance 606*c* (e.g., distance 606*a*>distance 606*b*>distance 606*c*). For example, the distance 606*r*, disposed near the exterior intersection 426, has a distance less than the distance 606*b*, and has a distance less than the distance 606*a*. In the illustrated embodiment, the metered channel 104 has a single step 608 along the opposing first portions 615*a*, 615*b*. Optionally, the metered channel 104 may have any number of steps between the opposing first portions 615*a*, 615*b* at increasing distances along the axis 402.

In the illustrated embodiment, the cooling assembly 100 includes two contingency holes 112*a*, 112*b*. The contingency hole 112*a* is disposed a distance 616*a* generally perpendicularly away from the axis 402, and the contingency hole 1126 is disposed a distance 616*b* generally perpendicularly away from the axis 402. For example, the contingency holes 112*a*, 112*b* are generally mirrored about the axis 402. Optionally, the contingency holes 112*a*, 112*b* may be disposed at non-mirrored positions about the axis 402. For example, the distance 616*a* may be different than the distance 616*b*. Optionally, the contingency holes 112*a* may be disposed at a position wherein the linear distance between the contingency holes 112*a*, 112*b* is non-perpendicular to the axis 402. Optionally, the contingency hole 112*a* may be disposed at any other position with respect to the axis 402 and/or the contingency hole 1121. Optionally, the cooling assembly 100 may include less than two or more than two contingency holes 112 that fluidly couple the metered channel 104 with the exterior surface 108. The contingency holes 112*a*, 112*b* are positioned proximate the interior intersection 424. For example, the contingency holes 112*a*, 112*b* are disposed at a position between the interior intersection 424 and the step 608. Additionally or alternatively, one or more of the contingency holes 112*a*, 112*b* may be disposed at a position between the step 608 and the exterior intersection 426. Optionally, one or more contingency holes 112 may be disposed in any other position within the metered channel 104 between the interior intersection 424 and the exterior intersection 426.

Returning to FIG. 4, the metered channel 104 has a distance 406 between opposing second portions 430*a*, 430*b* of the interior surface 403. In the illustrated embodiment, the distance 406 is generally uniform at increasing distances along the axis 402 from the cooling chamber 405 to the rail surface 110. For example, the distance 406 may be the distance measured along the shortest path between the opposing second portions 430*a*, 430*b*. The distance 406 remains generally unchanged at increasing distances along the axis 402. Optionally, the distance 406 may continually increase or decrease at increasing distances along the axis 402. Optionally, the distance 406 may increase then decrease, or decrease then increase, at increasing distances along the axis 402. Optionally, one or more steps may be included within the metered channel 104 along the opposing second portions 430*a*, 430*b*.

Figure 7A:
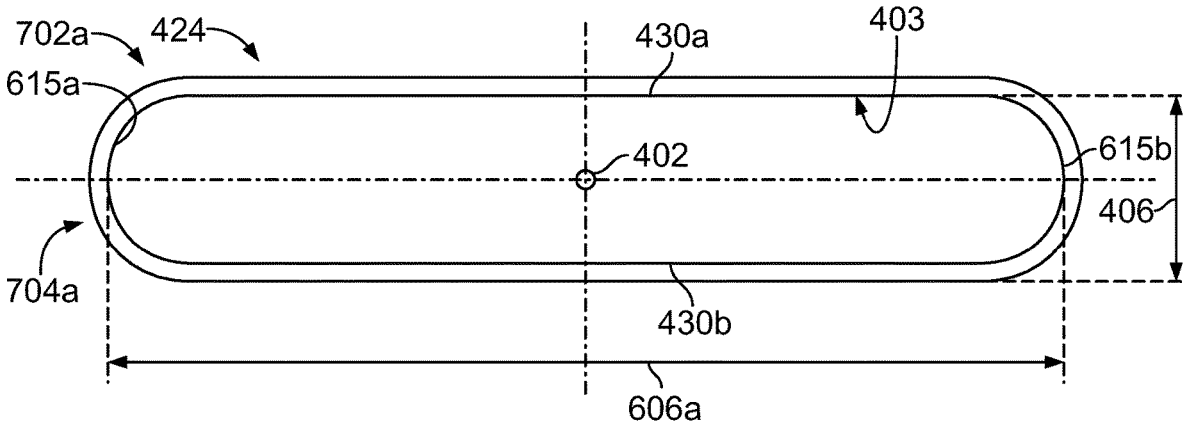
FIG. 7A illustrates a top view of the cooling assembly of FIG. 4 at an interior intersection in accordance with one embodiment.
Figure 7B:
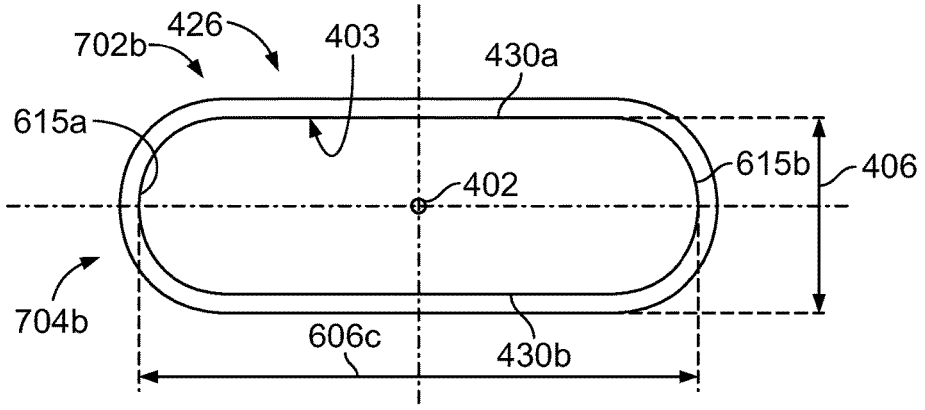
FIG. 7B illustrates a top view of the cooling assembly of FIG. 4 at an exterior intersection in accordance with one embodiment.

FIG. 7A illustrates a top view of the metered channel 104 at the interior intersection 424 between the cooling chamber 405 and the metered channel 104 centered, or substantially centered, about the axis 402 in accordance with one embodiment. FIG. 7B illustrates a top view of the metered channel 104 at the exterior intersection 426 between the metered channel 104 and the rail surface 110 centered, or substantially centered, about the axis 402. FIGS. 7A and 7B will be discussed in detail together.

In the illustrated embodiment of FIG. 7A, the metered channel 104 has a first cross-sectional shape 702*a* at the interior intersection 424 that is generally racetrack oval.

Optionally, the metered channel 104 may have any alternative cross-sectional shape and/or size at the interior intersection 424. The metered channel 104 has a first area 704*a* corresponding to the first cross-sectional shape 702*a* at the interior intersection 424.

At the interior intersection 424, the interior surface 403 has the opposing first portions 615*a*, 615*b* that are separated a distance apart by the distance 606*a* (of FIG. 6). Additionally, the interior surface 403 has the opposing second portions 430*a*, 430*b* that are separated a distance apart by the distance 406. In the illustrated embodiment, the distance 606*a* is greater than the distance 406. Optionally, the distance 606*a* may extend a distance that is equal to or less than the distance 406. In the illustrated embodiment of FIG. 7A, the axis 402 is generally centered about the opposing first portions 615*a*, 615*b* and the opposing second portions 430*a*, 430*b*. Alternatively, the axis 402 may not be generally centered about one or more of the opposing first portions 615*a*, 615*b* or the opposing second portions 430*a*, 430*b*.

In the illustrated embodiment of FIG. 7B, the metered channel 104 has a second cross-sectional shape 702*b* at the exterior intersection 426 that is generally racetrack oval. Optionally, the metered channel 104 may have any alternative cross-sectional shape and/or size at the exterior intersection 426. The metered channel 104 has a second area 704*b* corresponding to the second cross-sectional shape 702*b* at the exterior intersection 426.

At the exterior intersection 426, the opposing first portions 615*a*, 615*b* are separated a distance apart by the distance 606*c*. Additionally, the opposing second portions 430*a*, 430*b* are separated a distance apart by the distance 406. In the illustrated embodiment, the distance 606*c* is greater than the distance 406 at the exterior intersection 426. Optionally, the distance 606*c* may extend a distance than is equal to or less than the distance 406.

The first area 704*a* at the interior intersection 424 is different than the second area 704*b* at the exterior intersection 426. The first area 704*a* is greater than the second area 704*b* such that the metered channel 104 has an area ratio between the first area 704*a* and the second area 704*b* that is at least one. For example, the area ratio between the first area 704*a* and the second area 704*b* may be 1, 2, 3, or greater.

The flow area through which at least some of the cooling air flows in a direction from the cooling chamber 405 towards the rail surface 110 decreases with the continual decrease of the distances 606*a*, 606*b*, 606*c* between the interior intersection 424 and the exterior intersection 426. For example, the flow area constricts between the opposing first portions 615*a*, 615*b* between the cooling chamber 405 and the rail surface 110 along the axis 402. Additionally, the flow area remains generally uniform with the generally uniform distance 406 between the interior intersection 424 and the exterior intersection 426 along the axis 402. For example, the flow area remains generally unchanged between the opposing second portions 430*a*, 430*b* between the cooling chamber 405 and the rail surface 110 along the axis 402. Optionally, the distance 406 may continually increase or decrease, may increase then decrease, or decrease then increase between the interior intersection 424 and the exterior intersection 426. For example, the flow area may any combination of expand and/or constrict between the opposing second portions 430*a*, 430*b* along the axis 402.

Figure 8:
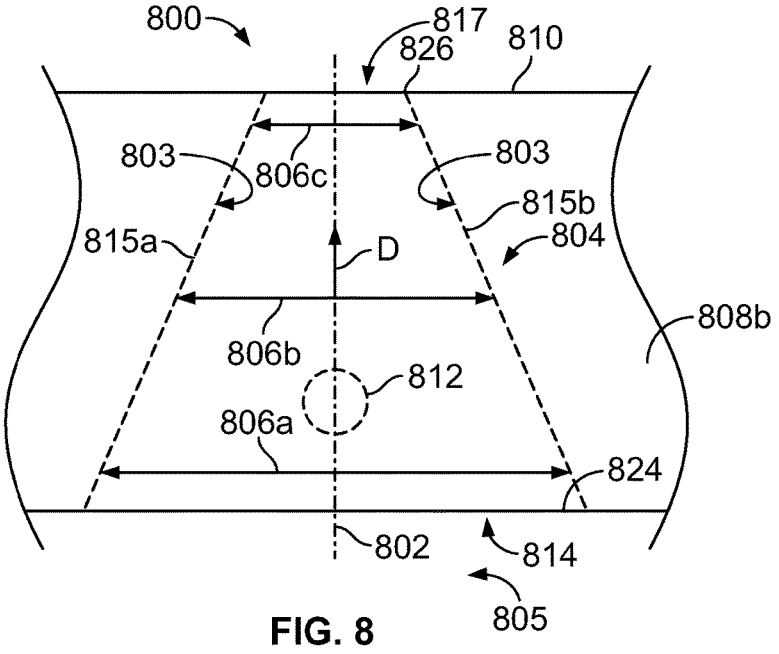
FIG. 8 illustrates a cross-sectional side view of a cooling assembly in accordance with one embodiment.

FIG. 8 illustrates a cross-sectional, side view of a cooling assembly 800 (corresponding to the cooling assembly 100 of FIG. 6) in accordance with one embodiment. The cooling assembly 800 includes a metered channel 804 that fluidly couples a cooling chamber 805 with a rail surface 810, and a contingency hole 812 that fluidly couples the metered channel 804 with exterior surfaces 808*a*, 808*b*. For example, the metered channel 804 is a passage between a channel inlet 814 at an interior intersection 824 between the cooling chamber 80S and the metered channel 804, and the channel outlet 817 at an exterior intersection 826 between the metered channel 804 and the rail surface 810. Additionally, the contingency hole 812 is a passage between a hole inlet at an, interior hole intersection (corresponding to the hole inlet 418 at the interior hole intersection 420 of FIG. 4) between the metered channel 804 and the contingency hole 812, and a hole outlet at an exterior hole intersection (corresponding to the hole outlet 423 at the exterior hole intersection 422 of FIG. 4) between the contingency hole 812 and the outer rail exterior surface 808*b*. For example, the metered channel 804 directs at least some of the cooling air exiting, the cooling chamber 805 towards the rail surface 810, and the contingency hole 812 directs at least some of the cooling air from the metered channel 804 towards the outer rail exterior surface 808*b*.

The metered channel 804 is elongated along and encompasses an axis 802. For example, the axis 802 extends through the general center of the metered channel 804, with the metered channel 804 being symmetric or substantially symmetric (symmetric within manufacturing tolerances) about or on either side of the axis 802. The metered channel 804 has an interior surface 803 that has opposing first portions 815*a*, 815*b* and opposing second portions (not shown). The metered channel 804 encompasses the axis 802 such that the axis 802 is generally centered between the opposing first portions 815*a*, 815*b*. For example, the opposing first portions 815*a*, 815*b* are generally mirrored about the axis 802 between the cooling chamber 805 and the rail surface 810. Optionally, the opposing first portions 815*a*, 815*b* may not be mirrored or generally mirrored about the axis 802.

The metered channel 804 includes distances 806*a*, 806*b*, 806*c* between the opposing first, portions 815*a*, 815*b* of the interior surface 810. The distances 806*a*, 806*b*, 806*c* generally decrease at increasing distances along the axis 802 in the direction D from the cooling chamber 805 to the rail surface 810. For example, the distances 806*a*, 806*b*, 806*c* may be the distance measured along the shortest path between opposing first portions 815*a*, 815*b*. In the illustrated embodiment, the metered channel 804 has a continuous decreasing distance 806*a*, 806*b*, 806*c* at increasing distances along the axis 802. The distance 806*a* may be largest at or near the interior intersection 824. The distance 806*b* may be smaller at or near the middle of the metered channel 804 along the axis 802, and may be smallest (e.g., as the distance 806*c*) at or near the exterior intersection 826. For example, the distance 806*a*, disposed near the interior intersection 824, has a distance that is greater than the distance 806*h*, and has a distance greater than the distance 806*c* (e.g., distance 806*a*>distance 806*b*>distance 806*c*). For example, the distance 806*c*, disposed near the exterior intersection 826, has a distance less than the distance 806*b*, and has a distance less than the distance 806*a*.

In the illustrated embodiment, the cooling assembly 800 includes a single contingency hole 812. The contingency hole 812 is disposed generally centered about the axis 802. For example, the contingency hole 812 is generally centered between the opposing first portions 815*a*, 815*b*. Additionally, the contingency hole 812 is disposed at a position closer to the interior intersection 824 than the exterior intersection 826. Optionally, the contingency hole 812 may be disposed at any position along the axis 802 between the interior intersection 824 and the exterior intersection 826. Optionally, the cooling assembly 800 may include more than one contingency holes 812, wherein one or more contingency holes 812 may be generally centered about the axis 802. Optionally one or more contingency holes 812 may be disposed in any other position within the metered channel 804.

Figure 9:
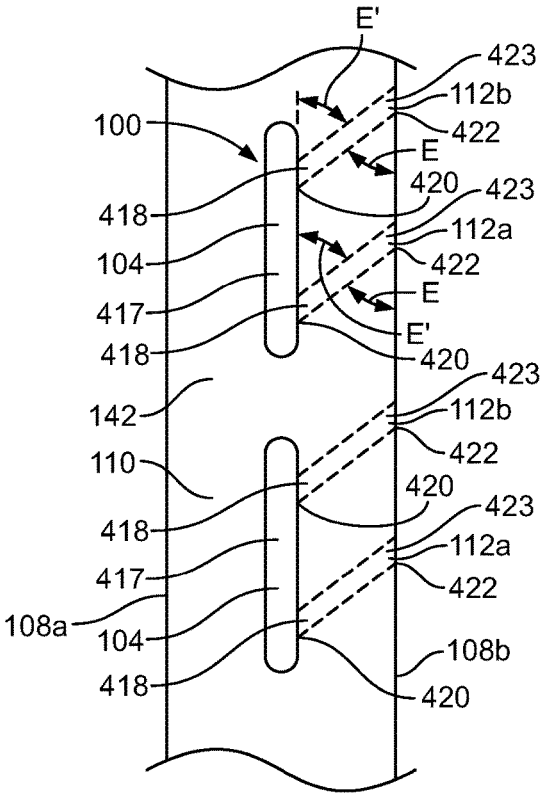
FIG. 9 illustrates a cross-sectional top view of a pressure side rail surface in accordance with one embodiment.

FIG. 9 illustrates a cross-sectional top view of the pressure side rail 142 in accordance with one embodiment. The illustrated embodiment illustrates the channel outlets 417 at the exterior intersection 426 of the rail surface 110, and contingency holes 112*a*, 112*b* that fluidly coupled the metered channels 104 with the outer rail exterior surface 108*b*. The contingency holes 112*a*, 112*b* are angularly offset from the outer rail exterior surface 108*b* by an angular degree E. For example, the contingency holes 112 may be angularly offset by 90 degrees or less. Optionally, the contingency holes 112 may be angularly offset from the metered channel 104 by the angular degree E'. For example, the contingency holes 112 may extend linearly between the hole inlet 418 and the hole outlet 423. Optionally, the contingency holes 112 may extend non-linearly between the hole inlet 418 and outlet 423. For example, the contingency holes 112 may be angularly offset from the outer rail exterior surface 108*b* by the angular degree E, and may be angularly offset from the metered channel 104 by a second, different angular degree E'. In the illustrated embodiment, the contingency holes are each angularly offset from the outer rail exterior surface 108*b* by the same or substantially the same angular degree E. Optionally, one or more contingency holes may be angularly offset by a different angular degree.

Figure 10:
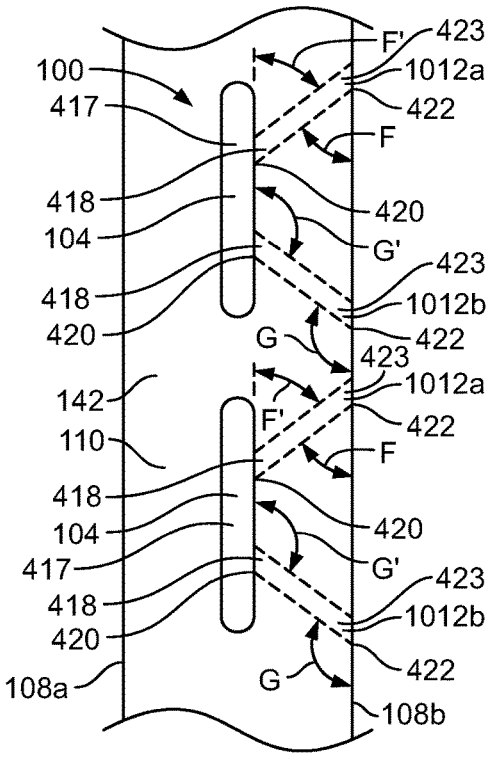
FIG. 10 illustrates a cross-sectional top view of a pressure side rail surface in accordance with one embodiment.

FIG. 10 illustrates a cross-sectional top view of the pressure side rail 142 in accordance with one embodiment. The illustrated embodiment illustrates the channel outlets 417 at the exterior intersection 426 of the rail surface 110, and contingency holes 1012*a*, 1012*b* (corresponding to the contingency holes 112*a*, 112*b*) that fluidly couple the metered channels 104 with the outer rail exterior surface 108*b*. The contingency holes 1012*a* are angularly offset from the outer rail exterior surface 108*b* by an angular degree F. Additionally, the contingency holes 1012*b* are angularly offset from the outer rail exterior surface 108*b* by an angular degree G, such that the angular degree G is different than the angular degree F. For example, the contingency holes 1012*a* may be angularly offset by 90 degrees of less and the contingency holes 1012*b* may be angularly offset by 90 degrees or more. The contingency holes 1012*a*, 1012*b* extend linearly between the hole inlet 418 and the hole outlet 423. Optionally, the contingency holes 1012*a*, 1012*b* may extend non-linearly. For example, the contingency holes 1012*a* may be angularly offset from the outer rail exterior surface 108*b* by the angular degree F., and may be angularly offset from the metered channel 104 by a second, different angular degree F.'. Additionally or alternatively, the contingency holes 1012*b* may be angularly offset from the outer rail exterior surface 108*b* by the angular degree G, and may be angularly offset from the metered channel 104 by a second, different angular degree G'.

In the illustrated embodiments of FIGS. 9 and 10, two cooling assembly 100 are illustrated having metered channels fluidly coupled with two contingency holes that extend in generally the same or different directions. Optionally, the metered channels may be fluidly coupled with a single contingency hole. Additionally or alternatively, the cooling assemblies may include one or more contingency holes that extend in any angular direction from the metered channel. For example, the airfoil 102 may include one or more cooling assemblies having one contingency hole, and one or more cooling assemblies having more than one contingency holes. Additionally or alternatively, cooling assemblies disposed on the suction side rail 144 may be in a similar pattern, different pattern, or random compared to the cooling assemblies disposed on the pressure side rail 142. Additionally or alternatively, the airfoil 102 may include one or more cooling assemblies disposed only on the pressure side rail 142, one or more cooling assemblies disposed only on the suction side rail 144, or any combination therebetween.

Figure 11:
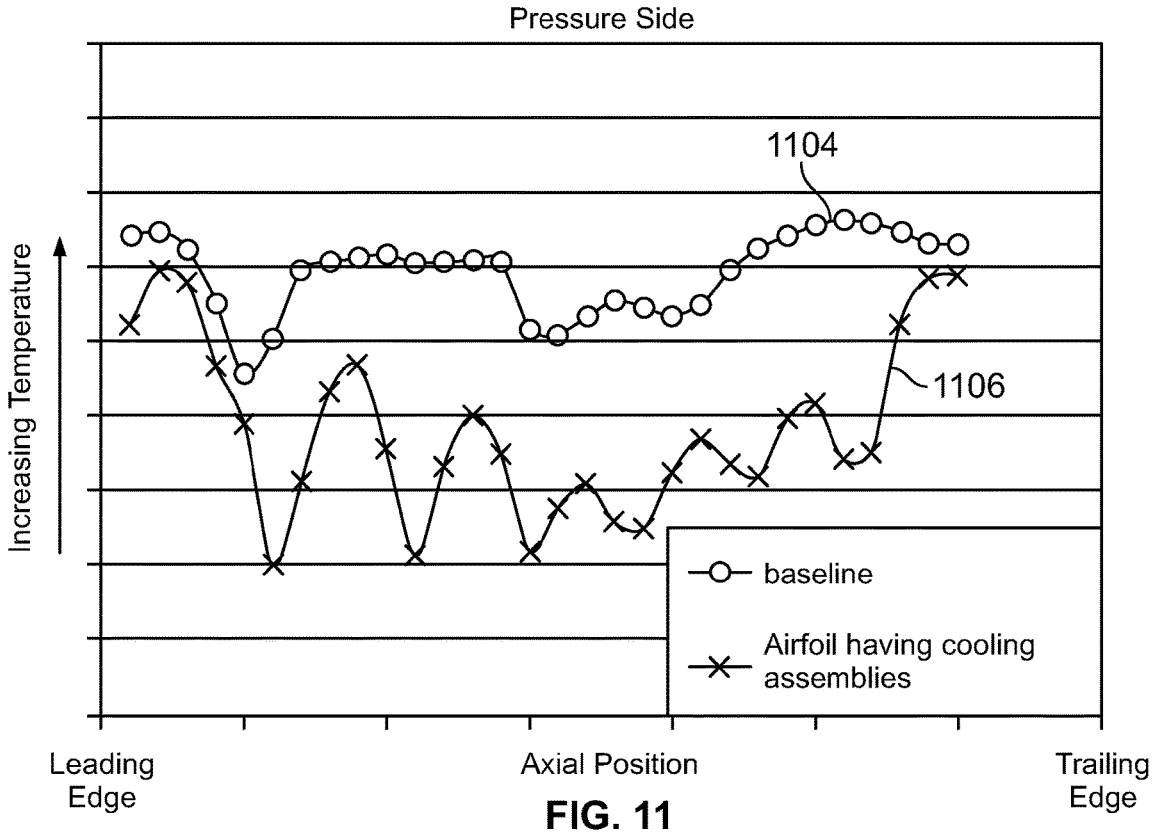
FIG. 11 illustrates a temperature graph along an exterior surface of an airfoil in accordance with one embodiment.

FIG. 11 illustrates a temperature graph along the exterior surfaces 108*a*, 108*b* of the pressure side 114 of the airfoil 102 in accordance with one embodiment. The horizontal axis represents a normalized distance between the leading edge 118 and the trailing edge 120 of the airfoil 102. The vertical axis represents increasing surface temperatures on the top of the pressure side rail 142 of the airfoil 102. Line 1104 represents a base airfoil that is void of any cooling assemblies (e.g., a cooling assembly representative of a current gas turbine blade tip). Line 1106 represents the airfoil 102 that includes cooling assemblies 100 disposed along the pressure side rail 142 between the leading edge 118 and the trailing edge 120 along the axial length 126 of the airfoil 102. The cooling assemblies include a metered channel (e.g., the metered channel 104) that is fluidly coupled with a cooling chamber (e.g., the cooling chamber 405), and a contingency hole (e.g., the contingency hole 112) fluidly coupled with the metered channel. The metered channels direct at least some of the cooling air exiting the cooling chamber outside of the rail surface, and the contingency hole direct at least of the cooling air out of the metered channel outside of the exterior surface of the airfoil.

Figure 12:
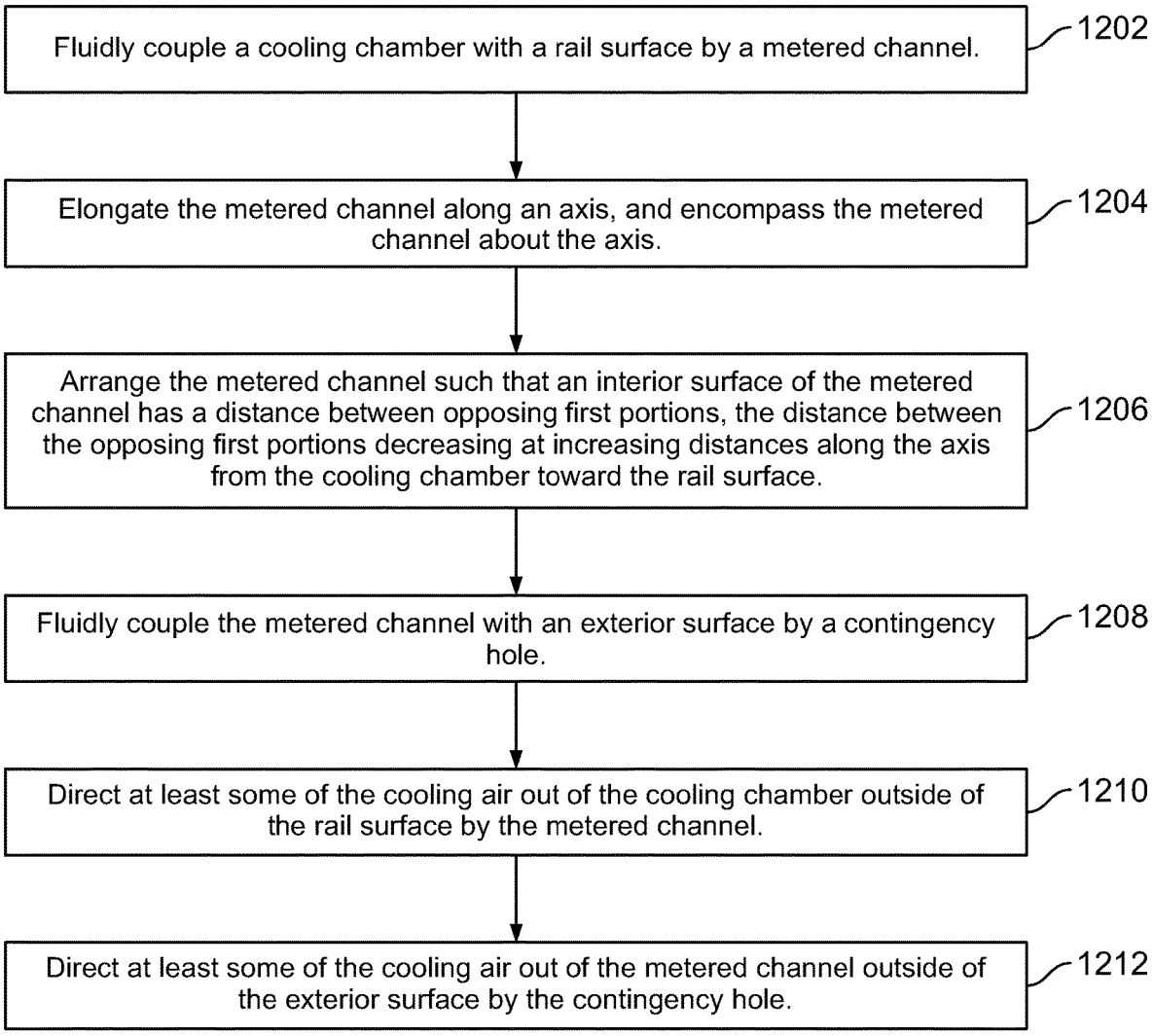
FIG. 12 illustrates a method flowchart in accordance with one embodiment.

FIG. 12 illustrates a method flowchart of operation of a cooling assembly (e.g., the cooling assemblies 100, 800) operating to help to cool an airfoil (e.g., airfoil 102) of a turbine assembly in accordance with one embodiment. At 1202, a cooling chamber (e.g., the cooling chamber 405) is fluidly coupled with a rail surface (e.g., rail surface 110) of the airfoil by a metered channel (e.g., the metered channel 104). For example, the metered channel may be passage between the cooling chamber and the rail surface. At 1204, the metered channel is elongated along and encompasses an axis between the cooling chamber and the rail surface. For example, the metered channel is generally symmetric about or on either side of the axis between the cooling chamber and the rail surface of the airfoil.

At 1206, the metered channel is arranged such that a distance between opposing first portions (e.g., the first portions 615*a*, 615*b*) of an interior surface of the metered channel decreases at increasing distances along the axis between the cooling chamber and the rail surface. For example, the distance between opposing first portions decreases at increasing distances along the axis such that the metered channel has a first area at an interior intersection (e.g., the first area 704*a* at the interior intersection 424) that is larger than a second area at an exterior intersection (e.g., the second area 704*b* at the exterior intersection 426).

At 1208, the metered channel is fluidly coupled with an exterior surface (e.g., the exterior surface 108) of the airfoil by a contingency hole the contingency hole 112). For example, the contingency hole may be a passage between the metered channel and the exterior surface.

At 1210, at least some of the cooling air is directed from the cooling chamber through the metered channel toward the rail surface of the airfoil. The flow area of the metered channel contracts between the cooling chamber and the rail surface. For example, the decreasing distance between opposing first portions along the axis causes the cooling air to contract as the cooling air is directed from the cooling chamber towards the exterior surface. At 1212, at least some of the cooling air is directed from the metered channel through the contingency hole toward the exterior surface of the airfoil.

In one embodiment of the subject matter described herein, a cooling assembly includes a cooling chamber disposed inside of a turbine assembly. The cooling chamber is configured to direct cooling air inside an airfoil of the turbine assembly. The cooling assembly includes a metered channel fluidly coupled with the cooling chamber. The metered channel is configured to direct at least some of the cooling air out of the cooling chamber outside of a rail surface of the airfoil. The metered channel is elongated along and encompasses an axis. The metered channel has an interior surface with a distance between opposing first portions of the interior surface. The distance between the opposing first portions of the interior surface decreases at increasing distances along the axis from the cooling chamber toward the rail surface.

Optionally, a contingency hole is fluidly coupled with the metered channel. The contingency hole is configured to direct at least some of the cooling air out of the metered channel and outside of an exterior surface of the airfoil.

Optionally, the metered channel has an inlet at an interior intersection between the metered channel and the cooling chamber and the metered channel has an outlet at an exterior intersection between the metered channel and the rail surface. Optionally, the inlet has a first area and the outlet has a second area that is smaller than the first area, such that the metered channel has an area ratio between the first area and second area of at least one.

Optionally, the rail surface is perpendicular to an exterior surface of the airfoil. Optionally, the contingency hole is angularly offset from the exterior surface of the airfoil.

Optionally, the rail surface extends a distance away from a tip floor surface of the airfoil, wherein the rail surface and the tip floor surface are parallel.

Optionally, the contingency hole directs the at least some of the cooling air exiting the metered channel along the exterior surface of the airfoil.

Optionally, the cooling air contracts along the axis from the cooling chamber toward the rail surface.

Optionally, the cooling assembly includes one or more additional contingency holes fluidly coupled with the metered channel, wherein the contingency hole and the one or more additional contingency holes are angularly offset from the exterior surface of the airfoil.

Optionally, the interior surface of the metered channel has opposing second portions. The opposing second portions are perpendicular to the opposing first portions. Optionally, a contingency hole is fluidly coupled with the metered channel. The contingency hole has a hole inlet at an interior hole intersection between the metered channel at one or more of the opposing second portions and the contingency hole.

Optionally, the airfoil is elongated along an axial direction of the turbine assembly. The cooling assembly further includes one or more additional metered channels, wherein the one or more additional metered channels fluidly couple the cooling chamber with an alternative exterior surface of one or more of a pressure side or a suction side of the airfoil.

In one embodiment of the subject matter described herein, a cooling assembly includes a cooling chamber disposed inside of a turbine assembly. The cooling chamber is configured to direct cooling air inside an airfoil of the turbine assembly. The cooling assembly includes a metered channel fluidly coupled with the cooling chamber. The metered channel is configured to direct at least some of the cooling air out of the cooling chamber outside of a rail surface of the airfoil. The metered channel has an inlet at an interior intersection between the metered channel and the cooling chamber and the metered channel has an outlet at an exterior intersection between the metered channel and the rail surface, wherein the inlet has a first area and the outlet has a second area that is smaller than the first area.

Optionally, a contingency hole is fluidly coupled with the metered channel. The contingency hole is configured to direct at least some of the cooling air out of the metered channel and outside of an exterior surface of the airfoil.

Optionally, the metered channel is elongated along and encompasses an axis. The metered channel has an interior surface with a distance between opposing first portions of the interior surface. The distance between the opposing first portions of the interior surface decreasing at increasing distances along the axis from the cooling chamber toward the rail surface.

Optionally, the rail surface is perpendicular to an exterior surface of the airfoil. Optionally, the contingency hole is angularly offset from the exterior surface of the airfoil.

Optionally, the rail surface extends a distance away from a tip floor surface of the airfoil. The rail surface and the tip floor surface are parallel.

Optionally, the contingency hole directs the at least some of the cooling air exiting the metered channel along the exterior surface of the airfoil.

Optionally, the cooling air contracts along the axis from the cooling chamber toward the rail surface.

Optionally, the cooling assembly includes one or more additional contingency holes fluidly coupled with the metered channel, wherein the contingency hole and the one or more additional contingency holes are angularly offset from the exterior surface of the airfoil.

Optionally, the interior surface of the metered channel has opposing second portions. The opposing second portions are perpendicular to the opposing first portions. Optionally, a contingency hole is fluidly coupled with the metered channel. The contingency hole has a hole inlet at an interior hole intersection between the metered channel at one or more of the opposing second portions and the contingency hole.

Optionally, the airfoil is elongated along an axial direction of the turbine assembly. The cooling assembly includes one or more additional metered channels, wherein the one or more additional metered channels fluidly couple the cooling chamber with an alternative exterior surface or one or more of a pressure side or a suction side of the airfoil.

In one embodiment of the subject matter described herein, a cooling assembly includes a cooling chamber disposed inside a turbine assembly. The cooling chamber is configured to direct cooling air inside an airfoil of the turbine assembly. The cooling assembly includes a metered channel fluidly coupled with the cooling chamber. The metered channel is configured to direct at least some of the cooling air out of the cooling chamber outside of a rail surface of the airfoil. One or more contingency holes are fluidly coupled with the metered channel. The contingency holes are configured to direct at least some of the cooling air out of the metered channel outside of an exterior surface of the airfoil.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(1), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A cooling assembly comprising:

a cooling chamber disposed inside of a turbine assembly, the cooling chamber configured to direct cooling air inside an airfoil of the turbine assembly;

a tip floor;

a metered channel fluidly coupled with the cooling chamber, the metered channel configured to direct at least some of the cooling air out of the cooling chamber outside of a rail surface of the airfoil, the metered channel being elongated along and encompassing an axis, the metered channel having an interior surface with a distance between opposing first portions of the interior surface, the distance between the opposing first portions of the interior surface continuously decreasing at increasing distances along the axis from a first point to a second point spaced apart from the first point from the cooling chamber toward the rail surface, the metered channel having a distance between opposing second portions of the interior surface, the distance between the opposing second portions of the interior surface remaining substantially unchanged along the axis from the first point to the second point from the cooling chamber toward the rail surface; and a contingency hole fluidly coupled with the metered channel, wherein the contingency hole is configured to direct at least some of the cooling air out of the metered channel and outside of an exterior surface of the airfoil, wherein the tip floor is disposed radially outward of at least a portion of the contingency hole.

2. The cooling assembly of claim 1, wherein the metered channel has an inlet at an interior intersection between the metered channel and the cooling chamber and the metered channel has an outlet at an exterior intersection between the metered channel and the rail surface.

3. The cooling assembly of claim 2, wherein the inlet has a first area and the outlet has a second area that is smaller than the first area, such that the metered channel has an area ratio between the first area and the second area of greater than one.

4. The cooling assembly of claim 1, wherein the rail surface is perpendicular to an exterior surface of the airfoil, and wherein the distance between opposing first portions of the interior surface decreases in a stepped manner.

5. The cooling assembly of claim 1, wherein the contingency hole is angularly offset from the exterior surface of the airfoil.

6. The cooling assembly of claim 1, wherein the rail surface extends a distance away from the tip floor surface of the airfoil, wherein the rail surface and the tip floor surface are parallel.

7. The cooling assembly of claim 1, wherein the contingency hole directs the at least some of the cooling air exiting the metered channel along the exterior surface of the airfoil.

8. The cooling assembly of claim 1, wherein the cooling air contracts along the axis from the cooling chamber toward the rail surface, and wherein the contingency hole further comprises a non-linear contingency hole.

9. The cooling assembly of claim 1, further comprising one or more additional contingency holes fluidly coupled with the metered channel, wherein the contingency hole and the one or more additional contingency holes are angularly offset from both the exterior surface of the airfoil and an inner rail exterior surface.

10. The cooling assembly of claim 1, wherein the opposing second portions of the interior surface of the metered channel are perpendicular to the opposing first portions.

11. The cooling assembly of claim 1, wherein the contingency hole has a hole inlet at an interior hole intersection between the metered channel at one or more of the opposing second portions and the contingency hole and a hole outlet at an exterior hole intersection between the metered channel and the exterior surface of the airfoil, and wherein the distance between opposing first portions of the interior surface decreases continuously at increasing distances along the axis from the hole inlet to the hole outlet.

12. The cooling assembly of claim 1, wherein the airfoil is elongated along an axial direction of the turbine assembly, and further comprising one or more additional metered channels, wherein the one or more additional metered channels fluidly couple the cooling chamber with an alternative exterior surface of one or more of a pressure side or a suction side of the airfoil.

13. A cooling assembly comprising:

a cooling chamber disposed inside of a turbine assembly, the cooling chamber configured to direct cooling air inside an airfoil of the turbine assembly, wherein the cooling chamber is entirely contained within the airfoil of the turbine assembly;

a metered channel fluidly coupled with the cooling chamber, the metered channel configured to direct at least some of the cooling air out of the cooling chamber outside of a rail surface of the airfoil, wherein the metered channel has an inlet at an interior intersection between the metered channel and the cooling chamber and the metered channel has an outlet at an exterior intersection between the metered channel and the rail surface, wherein the inlet has a first area and the outlet has a second area that is smaller than the first area, the metered channel having an interior surface extending along an axis between the inlet and the outlet, the interior surface including opposing first portions, wherein the distance between the opposing first portions continuously decreases from a first point to a second point spaced from the first point along the axis, and more than one contingency holes directly fluidly coupled with the metered channel, wherein one or more of the more than one contingency holes has a hole inlet at an interior hole intersection at the metered channel and a hole outlet at an exterior hole intersection at an exterior surface of the airfoil, the more than one contingency holes configured to direct at least some of the cooling air out of the metered channel and outside of the exterior surface of the airfoil, wherein each contingency hole of the more than one contingency holes is parallel to at least one adjacent contingency hole of the more than one contingency holes.

14. The cooling assembly of claim 13, wherein the interior surface includes opposing second portions that are perpendicular to the opposing first portions, wherein the distance between the opposing second portions remains substantially unchanged from the first point to the second point.

15. The cooling assembly of claim 13, wherein the rail surface is perpendicular to an exterior surface of the airfoil.

16. The cooling assembly of claim 13, wherein at least one contingency hole of the more than one contingency holes is angularly offset from the exterior surface of the airfoil.

17. The cooling assembly of claim 13, wherein the rail surface extends a distance away from a tip floor surface of the airfoil, wherein the rail surface and the tip floor surface are parallel.

18. The cooling assembly of claim 13, wherein at least one contingency hole of the more than one contingency holes directs the at least some of the cooling air exiting the metered channel along the exterior surface of the airfoil.

19. The cooling assembly of claim 13, wherein the cooling air contracts along the axis from the cooling chamber toward the rail surface.

20. The cooling assembly of claim 13, further comprising one or more additional contingency holes fluidly coupled with the metered channel, wherein the one or more additional contingency holes and the more than one contingency holes are angularly offset from the exterior surface of the airfoil.

21. The cooling assembly of claim 13, wherein the interior surface of the metered channel has opposing second portions, and wherein the opposing second portions are perpendicular to opposing first portions.

22. The cooling assembly of claim 13, wherein the airfoil is elongated along an axial direction of the turbine assembly, and further comprising one or more additional metered channels, wherein the one or more additional metered channels fluidly couple the cooling chamber with an alternative exterior surface of one or more of a pressure side or a suction side of the airfoil.

23. The cooling assembly of claim 13, wherein the interior intersection further comprises a first cross-sectional shape, and wherein the first cross-sectional shape is generally oval.

24. A cooling assembly comprising:

a cooling chamber disposed inside of a turbine assembly, the cooling chamber configured to direct cooling air inside an airfoil of the turbine assembly, the airfoil extending between a first end and a second end;

a tip floor disposed proximate the first end of the airfoil relative to the second end of the airfoil;

a metered channel fluidly coupled with the cooling chamber, the metered channel configured to direct at least some of the cooling air out of the cooling chamber outside of a rail surface at the first end of the airfoil, the rail surface and the tip floor extending in a substantially common direction, the metered channel having an interior surface extending along an axis between an inlet and an outlet, the interior surface including opposing first portions, wherein the distance between the opposing first portions continuously decreases from a first point to a second point spaced from the first point along the axis; and two or more contingency holes directly fluidly coupled with the metered channel, wherein each of the two or more contingency holes has a hole inlet at an interior hole intersection at the metered channel and a hole outlet at an exterior hole intersection at an exterior surface of the airfoil, the two or more contingency holes configured to direct at least some of the cooling air out of the metered channel outside of the exterior surface of the airfoil.

25. The cooling assembly of claim 24, wherein the inlet has a first area and the outlet has a second area, wherein the area ratio between the first area and the second area is at least one.

26. The cooling assembly of claim 24, wherein the interior surface includes opposing second portions that are perpendicular to the opposing first portions, wherein the distance between the opposing second portions remains substantially unchanged from the first point to the second point.

* * * * *